United States Patent [19]

Towns et al.

[11] 4,087,016

[45] May 2, 1978

[54] TIGHTLY SEALING SAFETY CAP

[75] Inventors: Edward Johnson Towns, Convent Station; Edward Morris Brown, Livingston; Leonard Dykstra, Hasbrouck Heights; Joseph Frank Spano, Westfield; John Daniel Proctor, Summit, all of N.J.

[73] Assignee: Lermer Packaging Corporation, Garwood, N.J.

[21] Appl. No.: 818,157

[22] Filed: Jul. 22, 1977

[51] Int. Cl.[2] ..... B65D 55/02; B65D 85/56; A61J 1/00

[52] U.S. Cl. ..... 215/211; 215/206; 215/223; 215/224; 215/350

[58] Field of Search ..... 215/206, 211, 223, 224, 215/341, 317, 350

[56] References Cited

U.S. PATENT DOCUMENTS

| | | | |
|---|---|---|---|
| 3,871,662 | 3/1975 | Hepp et al. | 215/206 X |
| 3,980,194 | 9/1976 | Costa | 215/206 X |
| 4,053,078 | 10/1977 | Herr | 215/211 X |

*Primary Examiner*—George T. Hall
*Attorney, Agent, or Firm*—Charles E. Temko

[57] ABSTRACT

A safety type cap for medicinal and similar containers capable of effecting a tight seal upon the container opening by means of a sealing flange extending laterally from the inner surface of the cap top, and which is deflected centripetally upon contact with the inner surface of the mouth of the container to result in resiliently bowing the top wall of the cap to result in increased outward pressure applied to the flange against the inner mouth surface. The radial thickness of the flange is substantially greater than the thickness of the cap top, so that the flange maintains a substantially undistorted shape during compression.

4 Claims, 8 Drawing Figures

FIG. 1
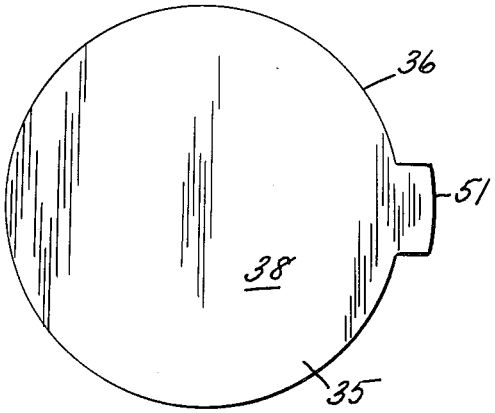
FIG. 2
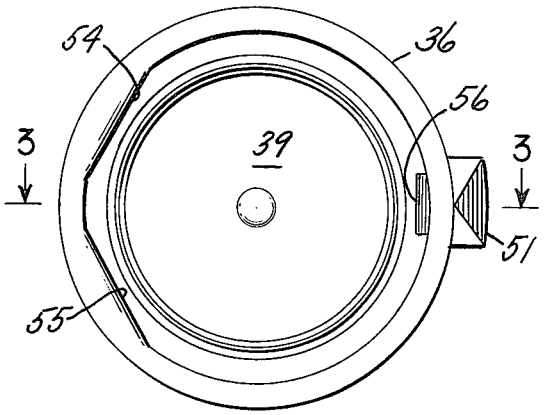
FIG. 3
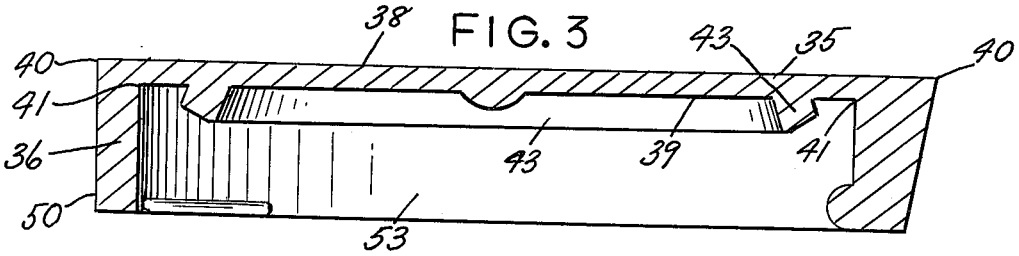
FIG. 4
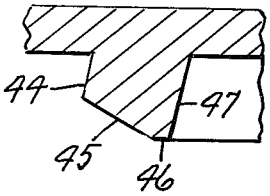
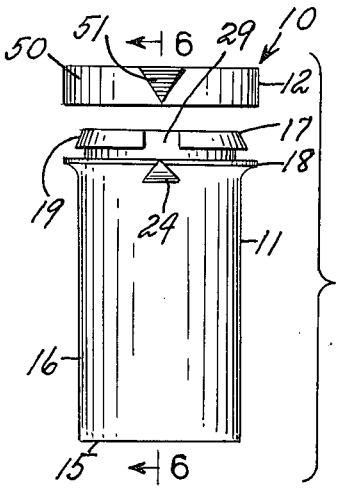
FIG. 5
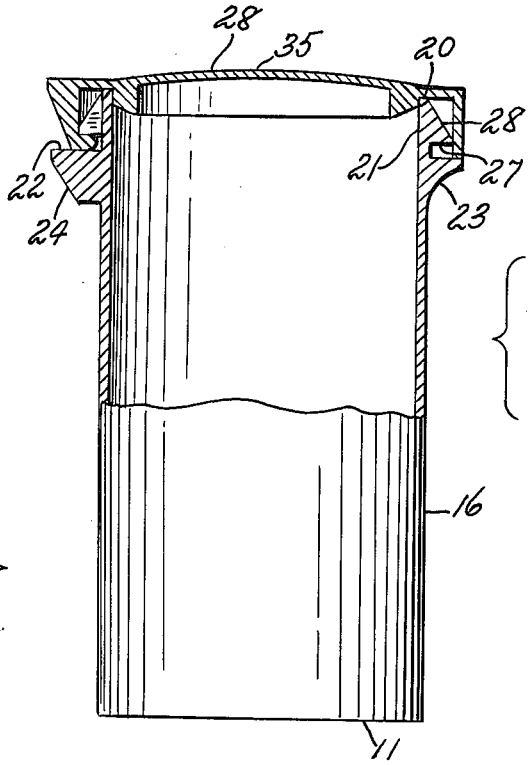
FIG. 6
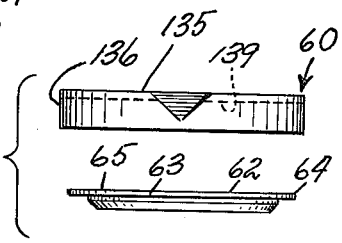
FIG. 7
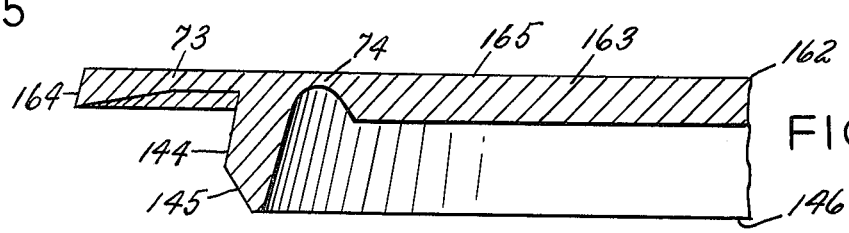
FIG. 8

TIGHTLY SEALING SAFETY CAP

BACKGROUND OF THE INVENTION

This invention relates generally to the field of container closures, and more particularly to an improved safety type closure or cap adapted to effect a substantially tight seal with respect to the mouth of a container.

As defined by National Formulary, since NF 7, effective from 1942 to 1947, a "well closed" container protects the contents from extraneous solids and from loss of the contents under ordinary or customary conditions of handling, shipment, storage and distribution.

By contrast, a "tight" container protects the contents from contamination by extraneous liquids, solids and vapors, from loss of the drug, and from efflorescence, deliquescence or evaporation under the ordinary or customary conditions of handling, shipment, storage and distribution, and, additionally, is capable of tight reclosure. As a general rule, a tight container must offer moisture permeability some 20 times less than a "well closed" container.

More recently, because of increased standards of safety from the standpoint of discovery and appropriation by children of tender years, container closures have been designed to require knowledgeable manipulation on the part of the user to open the closure, as a result of which recourse to the screw thread type of closure has been severely limited when a "tight" closure is required.

The most common type of safety closure employs a peripheral rim having at least one interrupted segment. A corresponding projection on the cap is rotatably aligned with the interrupted segment during the opening procedure, following which the cap may be lifted at this point to pivot the cap from the container. An example of this type of closure is disclosed in U.S. Pat. No. 3,669,295 of June 13, 1972 to William Horvath. Unlike screw type closures, in which the degree of tightness of the closure depends upon the degree the cap is twisted, snap type caps have a uniform degree of tightness which depends, among other factors, upon the degree of distortion imparted to the synthetic resinous components of the cap, and the elastic modulus of the material from which the cap is made. While it is possible to manufacture threaded type safety caps, including a freely turning outer shell which is engaged with an inner element upon the application of axially directed pressure upon the shell, such constructions are expensive, and require the provision of a resilient jacket of compressible material lining the end wall of the cap.

SUMMARY OF THE INVENTION

Briefly stated, the invention contemplates the provision of an improved safety type snap cap container, in which the container includes an open mouth having a smooth cylindrical inner surface, and an outer surface defining an annular flange having an indicated open segment. The cap has correspondingly located inner flange elements selectively engageable therewith, including a flange which is selectively alignable with the open segment of said annular flange on the container to allow removal of the cap. The end wall of the cap is relatively thin in cross section, and capable of resilient outward flexing to a bowed condition relative to the cylindrical side wall thereof. An inwardly directed annular flange extends downwardly from the inner surface of the end wall of the cap, and is of such cross sectional configuration as to be cammed centripetally upon engagement with the inner cylindrical surface of the container bordering the mouth thereof. This movement resiliently bows the end wall of the cap tending to increase the normal sealing force of the outer surface of the flange.

BRIEF DESCRIPTION OF THE DRAWINGS

In the drawings, to which reference will be made in the specification, similar reference characters have been employed to designate corresponding parts throughout the several views.

FIG. 1 is a top plan view of a synthetic resinous cap in accordance with a first embodiment of the invention.

FIG. 2 is a bottom plan view thereof.

FIG. 3 is a transverse central sectional view thereof, as seen from the plane 3—3 in FIG. 2.

FIG. 4 is an enlarged fragmentary sectional view thereof corresponding to the left hand portion of FIG. 3.

FIG. 5 is an exploded side elevational view of a complete container embodying the invention.

FIG. 6 is a transverse sectional view showing the structure of FIG. 5 in closed condition.

FIG. 7 is an exploded view of a cap element in accordance with a second embodiment of the invention.

FIG. 8 is a fragmentary vertical sectional view of a third embodiment of the invention.

DETAILED DESCRIPTION OF THE DISCLOSED EMBODIMENTS

In accordance with the first embodiment of the invention, the device, generally indicated by reference character 10, comprises broadly: a container element 11 and a cap element 12.

The container element 11 may be formed of glass or synthetic resinous materials, and includes a bottom wall 15, and a cylindrical side wall 16 having an upper end 17 defining an open mouth. Surrounding the end 17 is an upwardly tapered first flange 18 and a downwardly tapered second flange 19. The mouth 20 is bordered by a smooth inner cylindrical surface 21.

The first flange 18 serves a positioning function with respect to the cap element 12 when in engaged condition. It includes a planar upper surface 22 and a lower converging surface 23 mounting index means 24. The second flange 19 serves a retaining function with respect to the cap element, and includes a lower planar wall 27 and a tapered wall 28. A vertical slot 29 aligned with the index means 24 defines a discontinuous portion of the flange 19. Because of the presence of the slot 29, the effective thickness of the mouth 20 of the container is relatively thin, and, accordingly, a sealing function must be accomplished over a substantial portion of the cylindrical surface 21.

The cap element 12 is also molded from synthetic resinous materials, preferably a material having greater flexibility than the material employed in making the container element. Particularly suitable are polyethylene, polypropylene, and similar materials. The cap element includes a planar top wall 35 and a cylindrical side wall 36. The top wall 35 is bounded by an upper surface 38, a lower surface 39, an outer edge 40 and an inner edge 41. To permit a high degree of flexibility, it is of relatively thin cross section, having an effective thickness of approximately 0.030 inch where the overall diameter of the cap is approximately 1¼inches. Extending laterally inwardly from the lower surface 39 is a continuous sealing flange 43, the cross section of which is best seen in FIG. 5. It is bounded by an outer surface 44, a lower surface 45, an edge surface 46 and an inner surface 47. The outer surface 44 and inner surface 47 are approximately parallel and are disposed at approximately 15° from a plane perpendicular to the plane of the lower surface 39. The effective thickness of the flange, as measured between these surfaces is considerably greater than that of the thickness of the top wall 35, preferably over twice as thick. In the above example, the effective thickness is most properly about 0.065 inches. The lower surface 45 performs a camming function upon contact with the mouth 20 of the container, and when the cap is fully seated the outer surface 44 and inner surface 47 are substantially parallel to and concentric with the inner cylindrical surface 21 of the container.

The cylindrical side wall 36 is bounded by an outer surface 50, which may be grooved or otherwise roughened to provide convenient manual engagement. An index means 51 is selectively positionable opposite the index means 24 in well known manner to permit removal of the cap. Extending radially inwardly from an inner surface 53 are a pair of arcuate projections 54 and 55, as well as a disconnect projection 56 of width corresponding to the width of the vertical slot 29 with which it is alignable.

When the cap element 12 is engaged with the container element 11, centripetal distortion of the flange 43 is transmitted to the relatively thin wall 35 which resiliently bows outwardly generating a reactive force against the flange as distortion progresses. Thus, a substantial amount of radially outward pressure is maintained upon the surface 44 of the flange which is maintained in tight contact with the surface 21 of the container element.

Since the closed container, under normal conditions, is not pressurized, the outward bowing of the wall 35 is not accompanied by any tendency to lift the cap from engaged condition upon the container.

Turning now to the second embodiment of the invention, to avoid needless repetition, parts corresponding to those of the first embodiment have been designated by similar reference characters with the additional prefix "1".

While in the first embodiment, the sealing flange 43 is formed integrally with the wall 35 of the cap element 12, under certain conditions, particularly with larger diameter cap elements, it is sometimes desirable to form the sealing structure as a separate element. This permits the top wall and side wall of the cap element to be formed from a synthetic resinous material which is harder than that of the sealing flange, and permits the provision of a gasket-like insert which provides an additional sealing function.

Accordingly, in the second embodiment, generally indicated by reference character 60, the lower surface 139 is smooth, and a gasket-like member 62 is provided. A planar wall 63 of the gasket member is maintained in abutted relation with respect to the lower surface 139 of the cap by the engagement of the peripheral edge 64 thereof with the inner surface of the side wall 136. An upper surface 65 thereby lies in congruent relation with respect to the inner surface of the wall 135. When the second embodiment is engaged upon the container, because of this congruency, outward bowing of the wall 63 is resisted by the wall 135, so that an equivalent result is obtained.

Turning now to the third embodiment of the invention, as shown in FIG. 8 in the drawings, there is illustrated an alternate form of gasket-like member replacing the member 62 of the second embodiment. Generally, parts corresponding to those of the first and second embodiments have been designated by similar reference characters with the additional prefix "1", thereby avoiding needless repetition.

Under certain conditions, as for example when the cap is at least 1½ inches wide overall, the large area corresponding to the surface 44 of the first embodiment causes the developing of excessive frictional forces when in contact with the inner surface 21 of the container, and an attempt is made to twist the cap element relative to the container element. As a result, difficulty is experienced when attempting to remove the cap element. This is particularly true when the container element is formed of relatively soft synthetic resinous materials, such as polyethylene, as contrasted with relatively hard-surfaced materials such as polystyrene, cellulose acetate and the like.

In the third embodiment, the device, generally indicated by reference character 70 includes a gasket-like member 162 comprising a generally planar wall 163, bounded by a peripheral edge 164 and an upper surface 165. The cross sectional shape of the flange 143 corresponds generally to that of the flange 43 of the first embodiment, but is somewhat longer, the meeting of the surfaces 144 and 145 being more medially positioned in a circle 171, and rather less centrepetal deformation is contemplated when the cap element is positioned on the container element, so that the sealing area bordering the circle 171 is in the form of enlarged line contact, thereby reducing the total contact area, and the developed friction which results from a larger contact area.

Flexing is facilitated by forming areas 73 and 74 of relatively thin cross section inwardly and outwardly of the flange 143, which sections accommodate substantially all of the necessary flexing of the upper wall 163.

It is to be understood that it is not considered that the invention is limited to the precise details of structure shown and set forth in this specification, for obvious modifications will occur to those skilled in the art to which the invention pertains.

What is claimed is:

1. In a combination container and safety type cap therefor, the container including an open end portion defining a mouth and having a peripheral flange thereon, at least one segment of which is discontinuous, said cap including a generally planar end wall, a cylindrical side wall, and a plurality of inwardly facing projections selectively engaging said peripheral flange when said cap is in engaged condition upon said container, improved sealing means comprising: said container defining an inner substantially cylindrical surface in an area adjacent said mouth; said end wall of said cap having an inner surface and an annular inwardly directed sealing flange extending laterally from said inner surface; said flange having an effective radial thickness substantially greater than the thickness of said end wall, and an effective outer diameter slightly greater than the effective internal diameter of said cylindrical inner surface; said flange including an angularly disposed end surface forming camming means relative to said mouth; whereby, upon the closing of said cap upon said container, said flange contacts said opened end portion thereof to cam said flange within said mouth and centripetally compress said flange to a degree wherein the effective outer diameter thereof corresponds to the diameter of said inner cylindrical surface of said container, distortion of said flange being transmitted to said end wall of said cap to resiliently bow the same outwardly relative to said container.

2. A combination container and cap in accordance with claim 1, further characterized in said flange being formed integrally with said end wall of said cap.

3. A combination container and cap in accordance with claim 1, further characterized in said flange being formed upon a gasket-like insert positioned within said cap.

4. A combination container and cap in accordance with claim 3, further characterized in said insert having an end wall having areas of relatively thin cross section adjacent to an inwardly and outwardly of said flange.

* * * * *